US005109582A

United States Patent [19]

Okuda

[11] Patent Number: 5,109,582

[45] Date of Patent: May 5, 1992

[54] THREAD TENSIONING APPARATUS

[75] Inventor: Tetsuo Okuda, Gifu, Japan

[73] Assignee: CKD Corporation, Aichi, Japan

[21] Appl. No.: 601,661

[22] Filed: Oct. 25, 1990

[30] Foreign Application Priority Data

Oct. 25, 1989 [JP] Japan ..... 1-278824

[51] Int. Cl.[5] ..... B65H 1/00; B65H 75/38; D02H 13/38

[52] U.S. Cl. ..... 28/208; 28/192; 28/194; 28/196; 28/185

[58] Field of Search ..... 28/240, 241, 242, 192, 28/194, 196, 208, 185

[56] References Cited

U.S. PATENT DOCUMENTS

| | | | |
|---|---|---|---|
| 963,871 | 7/1910 | Colman | 28/208 |
| 1,342,876 | 6/1920 | Sinderson | 28/208 |
| 2,468,880 | 5/1949 | Johnson et al. | 28/194 |
| 2,499,888 | 3/1950 | Taylor | 28/194 X |
| 2,972,796 | 2/1961 | Block | 28/196 X |
| 3,180,004 | 4/1965 | Fisher et al. | 28/185 X |
| 4,326,322 | 4/1982 | Gaiser | 28/194 X |
| 4,630,340 | 12/1986 | Bauer et al. | 28/242 |
| 4,669,159 | 6/1987 | Bogucki-Land | 28/241 X |
| 4,852,225 | 8/1989 | Hagewood et al. | 28/242 |
| 4,941,240 | 6/1990 | Denzler et al. | 28/194 X |

*Primary Examiner*—Werner H. Schroeder
*Assistant Examiner*—Bibhu Mohanty
*Attorney, Agent, or Firm*—Wenderoth, Lind & Ponack

[57] ABSTRACT

A thread tensioning apparatus includes a pair of spaced arms that are simultaneously rotatable relative to supports to which the arms are mounted, a brush for catching threads and drawing out the threads from a thread beam, the brush being attached to the arms so as to be movable longitudinally of the arms and extending substantially perpendicularly to the arms, a movable member that is attached to each of the arms so as to be movable in the longitudinal direction of the arms, a comb that is attached to the movable member and extends substantially parallel to the drawing-out brush, a thread arranging brush that is rotatably attached to the movable member and extends substantially parallel to the comb, a pair of spaced clamp bars that are attached to the arms and extend substantially parallel to the drawing-out brush, and a pair of clamp members that are attached to the supports to cooperate with the clamp bars.

27 Claims, 4 Drawing Sheets

THREAD TENSIONING APPARATUS

FIELD OF THE INVENTION

The present invention relates to a thread tensioning apparatus which uniformly tensions warp threads in the form of a sheet in a step preparatory to weaving.

BACKGROUND OF THE INVENTION

A tensioning operation preparatory to weaving involves arranging nearly 10,000 warp threads in parallel in the form of a sheet, but there has heretofore been no satisfactory apparatus that conducts this operation automatically, and the thread tensioning operation still depends on manual labor in the present state of the art.

However, it is difficult to tension warp threads by a manual operation so that the degrees of overlap, inclination, tension and density of the threads always conform to specified amounts. Such a thread tensioning operation needs experienced and skilled laborers and also requires a great deal of time. In addition, if the tensioning of threads is not effectively performed, the operating efficiency of a drawing device that draws threads is also lowered.

SUMMARY OF THE INVENTION

It is an object of the present invention to provide a thread stretching apparatus which is capable of automatically drawing out a large number of warp threads from a beam and automatically uniformly tensioning them into the form of a sheet within one plane.

To this end, the present invention provides a thread tensioning apparatus comprising: a pair of spaced arms that are attached to supports so as to be simultaneously rotatable thereon; means for drawing out threads from a thread beam, the means being attached to the arms so as to be movable longitudinally of the arms and extending substantially perpendicularly to the arms; a movable member that is attached to each of the arms so as to be movable in the longitudinal direction of the arm; a comb that is attached to the movable member and extends substantially parallel to the drawing-out means; a thread arranging means that is rotatably attached to the movable member and extends substantially parallel to the comb; a pair of spaced clamp bars that are attached to the arms and extend substantially parallel to the drawing-out means; and a pair of clamp members that are attached to the supports to cooperate with the clamp bars.

In the above-described apparatus, a large number of threads which are drawn out from the thread beam are caught on the drawing-out means and are further drawn out from the beam by the movement of the drawing-out means. Thereafter, both the comb and the thread arranging means reciprocate one or more times longitudinally of the arms in response to the movement of the movable member, so that the threads are combed by the comb and arranged by the thread arranging means while being held by a holding bar. Upon completion of the combing and arrangement of the threads, the arms pivot, so that the clamp bars and the clamp members cooperate with each other to hold the arranged threads.

DETAILED DESCRIPTION OF THE PREFERRED EMBODIMENT

One embodiment of the present invention will be described below in detail with reference to the accompanying drawings.

Figure 1:
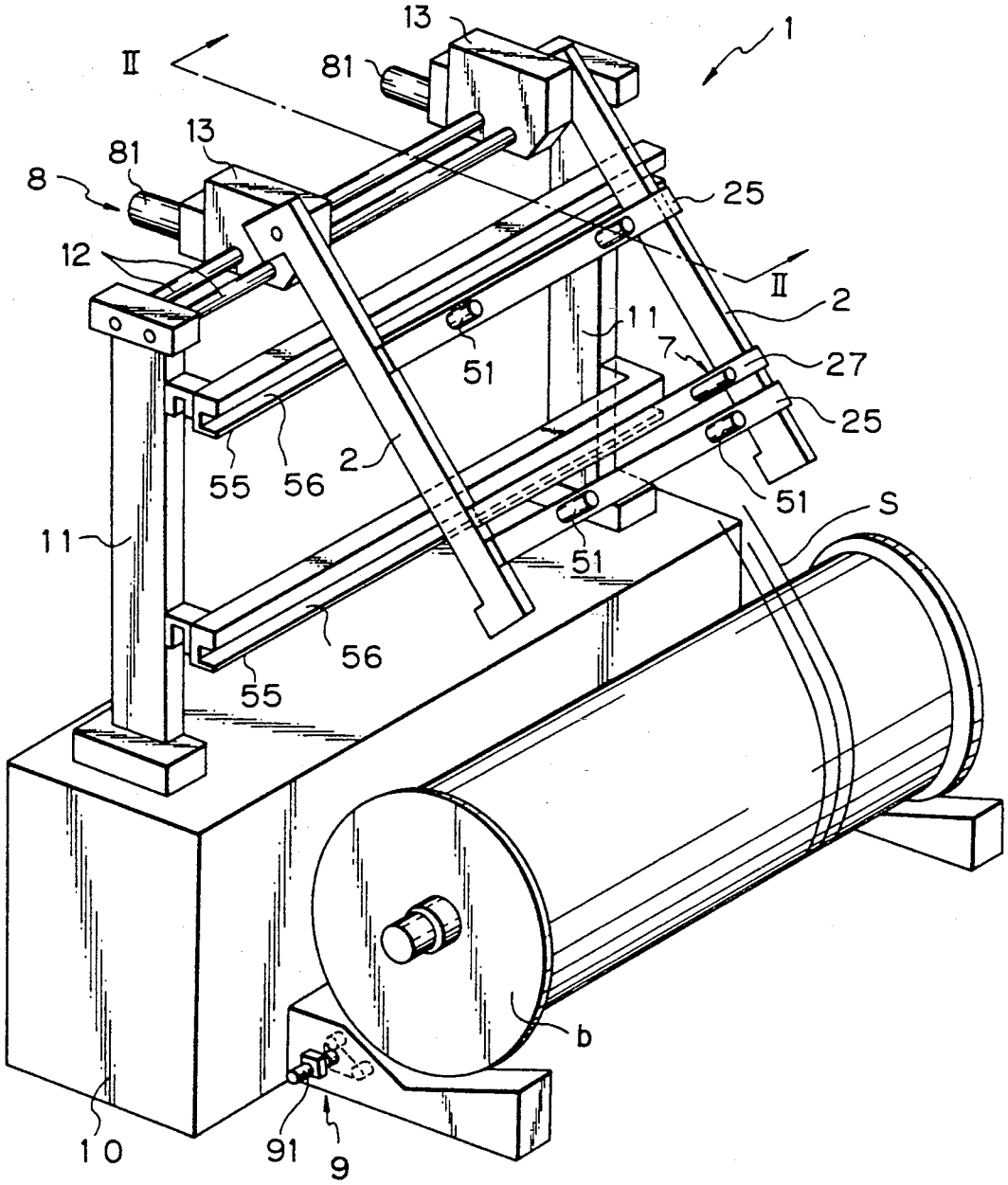
FIG. 1 is a perspective view of one embodiment of the thread tensioning apparatus according to the present invention, in which various mechanisms that are attached to the arms are not shown in order to simplify the illustration.

FIG. 1 schematically shows the entire thread tensioning apparatus 1 according to one embodiment of the present invention. The thread tensioning apparatus 1 comprises a base 10, a pair of spaced supports 11 that are vertically attached to the base 10, a pair of guide rods 12 that extend between the upper ends of the supports 11, a pair of mounting members 13 that are supported on the guide rods 12, and arms 2 that are pivotably attached to the respective mounting members 13.

Figure 3:
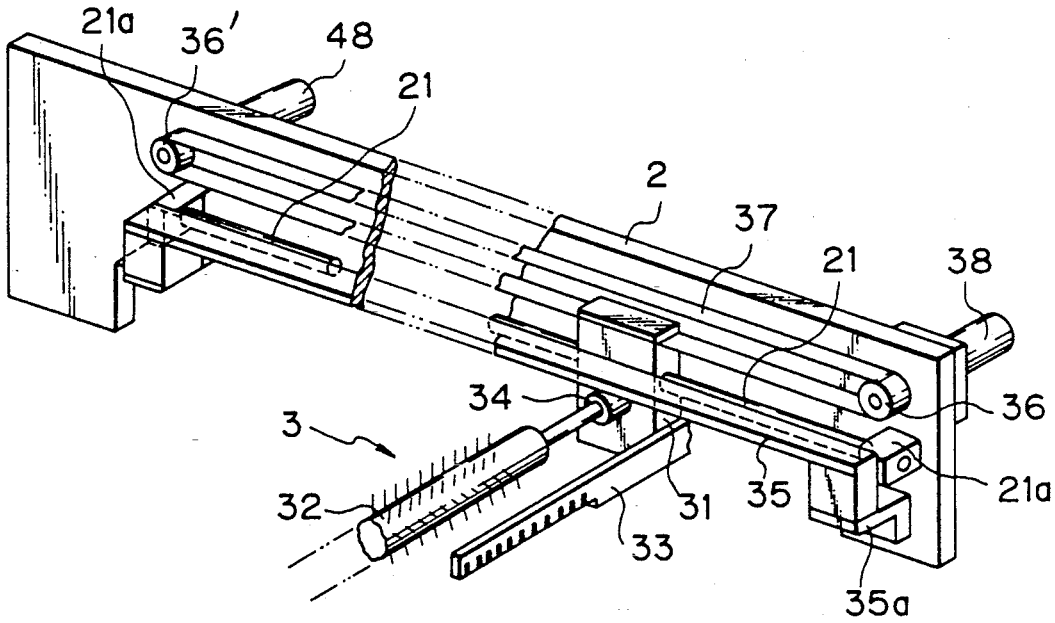
FIG. 3 is an enlarged perspective view showing the inner side of one arm.
Figure 4:
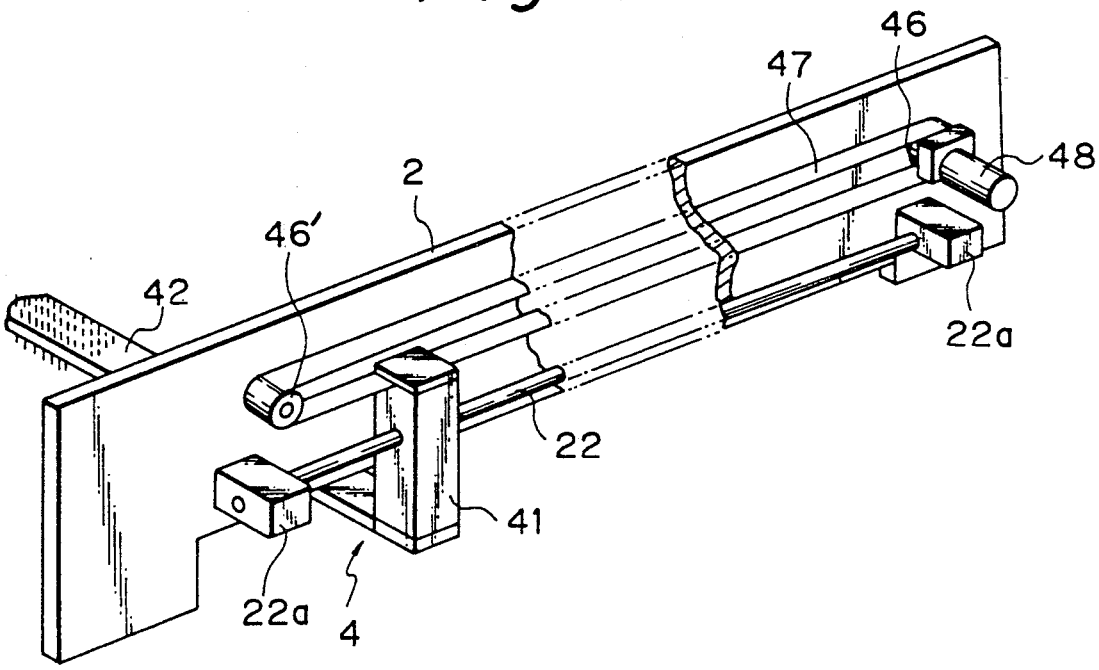
FIG. 4 is an enlarged perspective view showing the outer side of one arm.
Figure 5:
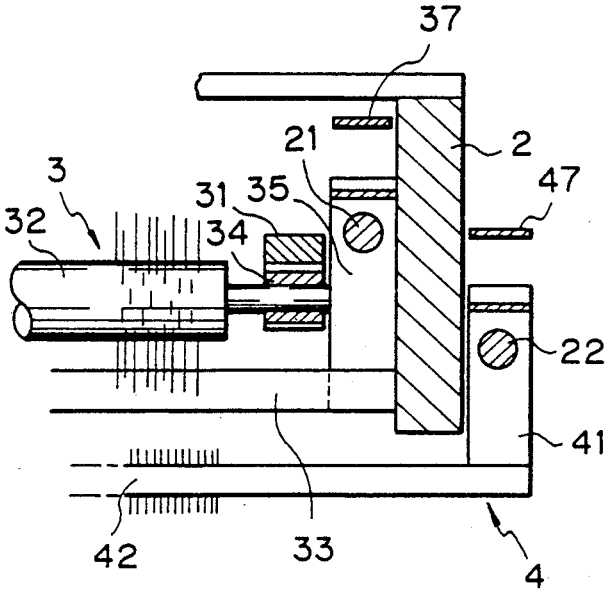
FIG. 5 is an enlarged sectional view taken along line V—V of FIG. 2.

Guide rods 21 are respectively mounted on the opposing sides (hereinafter referred to as "the inner sides") of the arms 2, each guide rod 21 extending longitudinally of the associated arm 2 and being attached thereto through a pair of brackets 21*a*, as shown in FIG. 3. On the other side (hereinafter referred to as "the outer side") of each arm 2 is mounted another guide rod 22 through a pair of brackets 22*a*, the guide rod 22 extending longitudinally of the arm 2, as shown in FIG. 4. The two guide rods 21 and 22 are offset from each other vertically as viewed in FIG. 5, which shows a cross section of one arm 2. The guide rod 21 movably supports a slider 31 of a thread arranging mechanism 3, while the guide rod 22 movably supports a slider 41 of a thread drawing-out mechanism 4. It should be noted that, since the two arms 2 have the same structure, and since the thread arranging mechanisms 3 and thread drawing-out mechanisms 4, which are attached to the two arms 2, have the same structures, the following description will be made in regard to only one arm 2.

One end of a thread arranging means, that is, thread arranging brush 32, of the thread arranging mechanism 3 is rotatably attached to the slider 31, and one end of a comb 33 is also secured to the slider 31. A pinion 34 is secured to the thread arranging brush 32 in close proximity to the slider 31, the pinion 34 meshing with a rack 35 that extends along the guide rod 21 and is secured to the arm 2 through a bracket 35*a*. The arm 2 has a pair of timing belt pulleys 36 and 36' which are rotatably attached to the inner side thereof. A timing belt 37 connects the timing belt pulleys 36 and 36'. The timing belt pulley 36 is driven by a motor 38. The timing belt 37 is secured to the slider 31. Accordingly, when the timing belt pulley 36 rotates back and forth, the timing belt 37 moves back and forth in response to the rotation of the pulley 36, and the slider 31 also reciprocates along the guide rod 21. The thread arranging brush 32 is rotated in the direction in which it brushes threads by the action of the rack 35 and the pinion 34. The thread arranging brush 32 has a structure in which wires extends radially from the outer periphery of a round bar that extends between the two arms 2. The comb 33 may have a known structure that is provided with a plurality of grooves having a width corresponding to the diameter of threads which are to be handled. The comb 33 is mounted in such a manner that the grooves face downward.

To the slider 41 is secured one end of a drawing-out means or drawing-out brush 42, of the thread drawing-out mechanism 4. A pair of timing belt pulleys 46 and 46' are rotatably attached to the outer side of the arm 2, and a timing belt 47 is stretched between the pulleys 46 and 46'. The timing belt pulley 46 is driven by a motor 48. Accordingly, by moving the timing belt 47 back and forth, the slider 41 reciprocates along the guide rod 22. The drawing-out brush 42 only serves to catch threads at the leading end portions thereof and draw them out from a thread beam b under the movement, thereof caused by the cooperation of the motor 48 and a drive motor 91 of a thread beam rotating mechanism 9 having a known structure. The drawing-out brush 42 may therefore have a known structure in which a large number of wires project from both surfaces of an elongated bar having a square cross-sectional configuration and which bar extends between the two arms 2.

Figure 6:
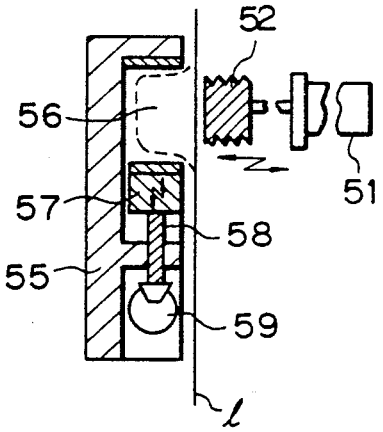
FIG. 6 is an enlarged sectional view of a clamp device as shown in detail.

Two beams 25 extend between the two arms 2 and are secured to each arm 2 at respective locations which are spaced apart from each other in the longitudinal direction of the arm 2. A pair of clamp cylinders 51 that constitute clamp devices 5 and 5' are attached to each beam 25. Clamp bars 52 are attached to the clamp cylinders 51 so as to extend at right angles to the arms 2. Thus, the clamp bars 52 can be moved substantially perpendicularly to the longitudinal direction of the arms 2 by activating the clamp cylinders 51. A pair of clamp members 55 are secured to the supports 11, the clamp members 55 being spaced apart from each other longitudinally of the supports 11. The clamp members 55 extend parallel to the clamp bars 52. The clamp members 55 are mounted at respective positions which are determined so that the distance of each clamp member 55 from the center "0" of rotation of the arms 2 is the same as the distance of the corresponding clamp bar 52 from the center "0" of rotation. Each clamp member 55 defines a recess 56 that receives the corresponding clamp bar 52, so that, when the arms 2 are pivoted to a position where they face down as viewed in FIG. 2, the recesses 56 are in alignment with the clamp bars 52. As is shown in FIG. 6 in detail, a press bar 57 is disposed within the recess 56 in each clamp member 55, the bar 57 extending over substantially the entire length of the recess 56. The press bar 57 can be moved toward and away from the clamp bar 52 in the recess 56 by rotating a screw shaft 58 which is in threaded engagement with the clamp member 55, by means of a motor 59.

Figure 7:
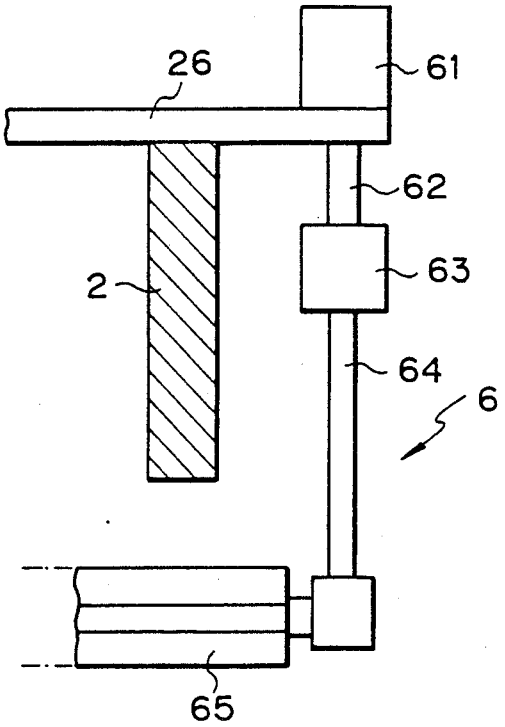
FIG. 7 is an enlarged view of a part of the thread tensioning apparatus as seen in the direction of the arrow VII in FIG. 2.
Figure 8:
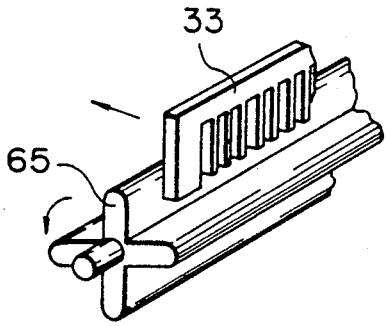
FIG. 8 is a partial perspective view of a holding bar and a comb, which are employed in the present invention.

A beam 26 is attached to the pair of arms 2 near the center 0 of rotation. Both ends of the beam 26 project outward from the arms 2, and a cylinder 61 of a thread holding mechanism 6 is attached to each projecting end of the beam 26, as shown in FIG. 7. The cylinder 61 has a relatively short stroke, and a cylinder 63 which similarly has a relatively short stroke is attached to a piston rod 62 of the cylinder 61. A bearing member is attached to the distal end of a piston rod 64 of the cylinder 63, and a holding bar 65 is rotatably supported by the bearing member, the holding bar 65 extending along side the beam 26. The holding bar 65 has a cross-shaped cross-sectional configuration and is arranged to rotate about 90° when the comb 33 of the thread arranging mechanism 3, moving upward as viewed in FIG. 2, further moves upward from a state where the end of the comb 33 abuts against the holding bar 65, as shown in FIG. 8.

Reference numeral 7 denotes a tension sensor which is mounted on a beam 27 attached to the arms 2, the tension sensor 7 having a known structure to detect a degree of tension applied to the threads. The operation of the apparatus can be started and stopped in response to a signal that is generated by the tension sensor 7.

It should be noted that the arms 2 are pivoted by the operation of a pivoting mechanism 8 including swing motors 81 that are attached to the mounting members 13, respectively. The pivoting mechanism 8 may have a known structure that is only required to cause the support shafts that define the center 0 of rotation of the arms 2 to pivot when are actuated the swing motors 81 and a detailed description thereof is therefore omitted.

The operation of the thread tensioning apparatus 1, having the above-described arrangement, will next be explained.

Figure 2:
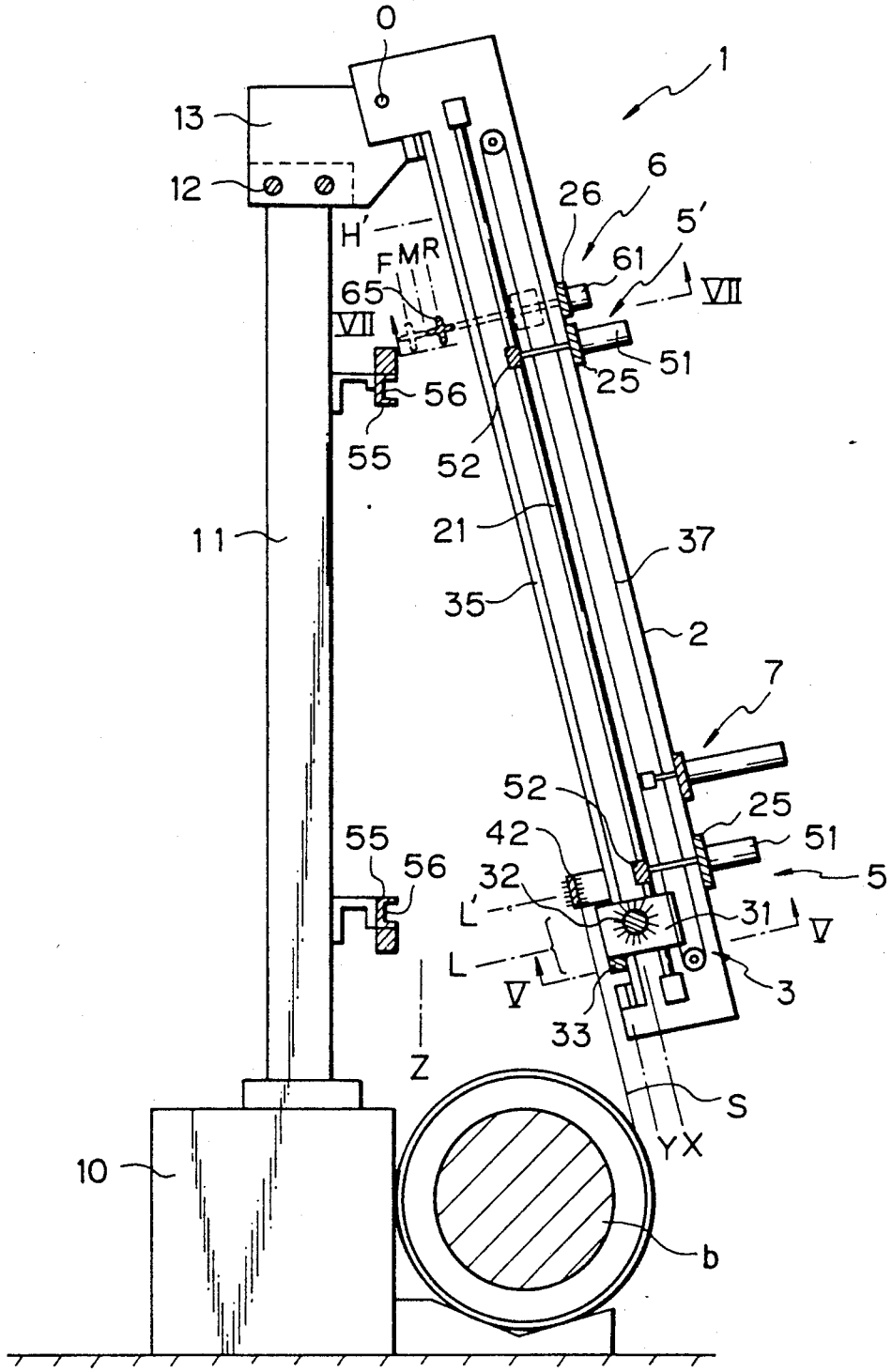
FIG. 2 is a sectional view of the thread tensioning apparatus taken along line II—II of FIG. 1.

First, the arms 2 are at rest at the position X that is shown by the solid line in FIG. 2. Since in this state the slider 31 of the thread arranging mechanism 3 and the slider 41 of the thread drawing-out mechanism 4 are near one end (the lower end as viewed in FIG. 2) of the arms 2, the thread arranging brush 32 and the comb 33 stand by at the lower position L and the thread drawing-out brush 42 also stands by at the lower position L'. The two cylinders 61 and 63 of the thread holding mechanism 6 are at rest in a state where the respective piston rods project to the utmost limit. Accordingly, the holding bar 65 is at the forward position F, that is, the remotest position from the beam 26, so that the drawing-out brush 42 can move upward through the gap between the arms 2 and the holding bar 65. When the arms 2 are in this position, a large number of threads s which are drawn out from the thread beam b are latched onto the drawing-out brush 42 by a manual operation. After the completion of this operation, the motor 48 of the thread drawing-out mechanism 4 is activated to move the timing belt 47, thereby raising the drawing-out brush 42 as far as the position H', thus drawing out the threads s from the thread beam b. The movement of the drawing-out brush 42 is suspended at this position.

Next, the pivoting mechanism 8 is activated to pivot the arms 2 a little in the clockwise direction as viewed in FIG. 2 until the tension sensor 7 outputs a detected signal, thus bringing the arms 2 to the position Y. At this time, the drawing-out brush 42 which is near the upper end of the arms 2 moves clockwise about the center 0 of rotation of the arms 2 together therewith. However, since the drawing-out brush 42 is close to the center 0 of rotation, the traveled distance of the brush 42 is limited, whereas the traveled distance of the thread arranging brush 32 and the comb 33, which are near the lower end of the arms 2, is relatively large. Accordingly, the threads s enter the grooves in the comb 33 and engage with the thread arranging brush 32. In addition, the piston rods of the two cylinders 61 and 63 of the holding mechanism 6 retract to move the holding bar 65 to the rearward position. In this state, the motor 38 of the thread arranging mechanism 3 is activated to move the thread arranging brush 32 and the comb 33 toward the upper end (as viewed in FIG. 2) of the arms 2. When the thread arranging brush 32 and the comb 33 come to the holding bar 65 of the holding mechanism 6 on the way to the upper position, the brush 32 clears the holding bar 65, but the comb 33 abuts against the holding bar 65, as shown in FIG. 8, thus causing the holding bar 65 to rotate about 90°. The holding bar 65 continues to be in contact with the threads s even after the rotation, thus holding the threads s. In this way, a large number of threads s are arranged and combed. After this operation, the cylinder 63 is activated to move the holding bar 65 to the position M, and the arms 2 are then pivoted counterclockwise to the position X. Further, the thread arranging brush 32 and the comb 33 are returned to the positions L, L' at the lower end of the arms 2. If the threads s cannot be completely arranged and combed in a single operation, the thread arranging and combing operation is conducted again in the same way as outlined above. The operation may be repeated many times if necessary.

After the threads s have been satisfactorily arranged, the arms 2 are pivoted further clockwise by the cooperation of the pivoting mechanisms 8 and 9 under the control of a signal that is detected by the tension sensor 7 until the arms 2 reach the position Z where they face downward as viewed in FIG. 2. When the arms 2 come to a stop at the position Z, the clamp cylinders 51 of the clamp devices 5 and 5' are activated to push the clamp bars 52 into the recesses 56 in the clamp members 55. In consequence, the threads s are held between the clamp bars 52 and the clamp members 55. Further, the press bars 57 are moved by the associated motors 59 so as to cooperate with the clamp bars 52 to tightly fix the threads s.

The threads s arranged in this way are then delivered for processing in a subsequent step.

According to the present invention, it is possible to automate the thread arranging operation and hence eliminate discrepancies in the final product due to the fact that different individuals may carry out the thread arranging operation. In addition, it becomes possible to increase the speed of the thread arranging operation and to therefore increase the operating efficiency in a series of steps preparator to weaving.

Although the best mode contemplated by the inventor for carrying out the present invention has been shown and described herein, it will be apparent to those skilled in the art that suitable modifications, variations, and equivalents may be made without departing from the scope of the invention, such a scope being limited solely by the terms of the following claims.

I claim:

1. A thread tensioning apparatus comprising:

supports fixed in the apparatus;

a pair of spaced arms that are attached to said supports so as to be simultaneously rotatable relative to said supports;

drawing-out means for catching threads, said drawing-out means being attached to said arms so as to be movable longitudinally of said arms to draw out threads caught thereon, and said drawing-out means extending substantially perpendicularly to said arms;

a first movable member that is attached to each of said arms so as to be movable in the longitudinal direction of said arms;

a comb that is attached to said movable member and extends substantially parallel to said drawing-out means;

thread arranging means, rotatably attached to said movable member and extending substantially parallel to said comb, for arranging threads disposed thereon;

a pair of spaced clamp bars that are attached to said arms and extend substantially parallel to said drawing-out means; and a pair of clamp members that are attached to said supports to cooperate with said clamp bars.

2. A thread tensioning apparatus according to claim 1, wherein said thread arranging means is a cylindrical brush, and further comprising a rack that is attached to each of said arms and extends along the direction of movement of said first movable member, and a pinion that is secured to said brush and meshes with said rack.

3. A thread tensioning apparatus according to claim 1, wherein said drawing-out means is a drawing-out brush, and further comprising a second movable member supporting said drawing-out brush and attached to each of said arms so as to be movable longitudinally thereof.

4. A thread tensioning apparatus according to claim 1, and further comprising a belt to which said first movable member is attached, and a plurality of belt pulleys which are rotatably mounted to each of said arms, said belt extending around said pulleys and wherein, said first movable member is movable by said belt.

5. A thread tensioning apparatus according to claim 3, and further comprising a belt to which said second movable member is attached, and a plurality of belt pulley which are rotatably mounted to each of said arms, said belt extending around said pulleys and wherein, said second movable member is movable by said belt.

6. A thread tensioning apparatus according to claim 1, and further comprising a thread holding mechanism having a holding bar that is rotatably attached to said arms and extends substantially parallel to said comb at such a location as to cooperate with said comb.

7. A thread tensioning apparatus according to claim 3, and further comprising a thread holding mechanism having a holding bar that is rotatably attached to said arms and extends substantially parallel to said comb at such a location as to cooperate with said comb.

8. A thread tensioning apparatus according to claim 6, wherein said thread holding mechanism includes a plurality of cylinders connected to said holding bar, said holding bar being movable by said cylinders toward and away from said arms.

9. A thread tensioning apparatus according to claim 7, wherein said thread holding mechanism includes a plurality of cylinders connected to said holding bar, said holding bar being movable by said cylinders toward and away from said arms.

10. A thread tensioning apparatus according to claim 1, and further comprising cylinder means for moving each of said clamp bars relative to said arms.

11. A thread tensioning apparatus according to claim 3, and further comprising cylinder means for moving each of said clamp bars relative to said arms.

12. A thread tensioning apparatus according to claim 1, and further comprising a tension sensor for detecting a degree of tension of threads drawn out in the apparatus.

13. A thread tensioning apparatus according to claim 3, and further comprising a tension sensor for detecting a degree of tension of threads drawn out in the apparatus.

14. A thread tensioning apparatus according to claim 1, wherein each of said clamp members has a press bar, and means for moving said press bar to hold threads in cooperation with said clamp bar.

15. A thread tensioning apparatus according to claim 3, wherein each of said clamp members has a press bar, and means for moving said press bar to hold threads in cooperation with said clamp bar.

16. A thread tensioning apparatus according to claim 2, wherein said drawing-out means is a drawing-out brush, and further comprising a second movable member supporting said drawing-out brush and attached to each of said arms so as to be movable longitudinally thereof.

17. A thread tensioning apparatus according to claim 16, and further comprising a belt to which said second movable member is attached, and a plurality of belt pulleys which are rotatably mounted to each of said arms, said belt extending around said pulleys and wherein, said second movable member is movable by said belt.

18. A thread tensioning apparatus according to claim 2, and further comprising a belt to which said first movable member is attached, and a plurality of belt pulleys which are rotatably mounted to each of said arms, said belt extending around said pulleys and wherein, said first movable member is movable by said belt.

19. A thread tensioning apparatus according to claim 2, and further comprising a thread holding mechanism having a holding bar that is rotatably attached to said arms and extends substantially parallel to said comb at such a location as to cooperate with said comb.

20. A thread tensioning apparatus according to claim 16, and further comprising a thread holding mechanism having a holding bar that is rotatably attached to said arms and extends substantially parallel to said comb at such a location as to cooperate with said comb.

21. A thread tensioning apparatus according to claim 2, and further comprising cylinder means for moving each of said clamp bars relative to said arms.

22. A thread tensioning apparatus according to claim 16, and further comprising cylinder means for moving each of said clamp bars relative to said arms.

23. A thread tensioning apparatus according to claim 2, and further comprising a tension sensor for detecting a degree of tension of threads drawn out in the apparatus.

24. A thread tensioning apparatus according to claim 16, and further comprising a tension sensor for detecting a degree of tension of threads drawn out in the apparatus.

25. A thread tensioning apparatus according to claim 2, wherein each of said clamp members has a press bar, and means for moving said press bar to hold threads in cooperation with said clamp bar.

26. A thread tensioning apparatus according to claim 16, wherein each of said clamp members has a press bar, and means for moving said press bar to hold threads in cooperation with said clamp bar.

27. A thread tensioning apparatus according to claim 20, wherein said thread holding mechanism includes a plurality of cylinders connected to said holding bar, said holding bar being movable by said cylinders toward and away from said arms.

* * * * *